United States Patent [19]

Morita et al.

[11] Patent Number: 4,788,812

[45] Date of Patent: Dec. 6, 1988

[54] METHOD AND APPARATUS FOR STACKING ELONGATED TAPE-LIKE ARTICLES

[75] Inventors: Toyoo Morita, Uoza; Hideki Akiyama, Toyama, both of Japan

[73] Assignee: Yoshida Kogyo K. K., Tokyo, Japan

[21] Appl. No.: 83,464

[22] Filed: Aug. 10, 1987

[30] Foreign Application Priority Data

Aug. 11, 1986 [JP] Japan ..... 61-188212

[51] Int. Cl.[4] ..... B65B 35/50; B65B 39/02; B65B 39/04

[52] U.S. Cl. ..... 53/447; 53/540; 53/247

[58] Field of Search ..... 53/447, 540, 541, 537, 53/475, 531, 247, 249

[56] References Cited

U.S. PATENT DOCUMENTS

| | | | |
|---|---|---|---|
| 2,767,534 | 10/1956 | Nydegger et al. | 53/540 X |
| 3,063,213 | 11/1962 | Goran, Jr. | 53/244 |
| 3,415,034 | 12/1968 | Schmitt | 53/307 X |
| 3,641,735 | 2/1972 | Daily et al. | 53/537 |
| 4,124,128 | 11/1978 | Adams et al. | 53/143 X |
| 4,570,422 | 2/1986 | Watanabe et al. | 53/557 |
| 4,610,124 | 9/1986 | Watanabe et al. | 53/399 |
| 4,624,369 | 11/1986 | Okada | 209/626 |
| 4,660,352 | 4/1987 | Deines et al. | 53/543 X |
| 4,665,679 | 5/1987 | Watanabe | 53/131 |

FOREIGN PATENT DOCUMENTS 62-94523 5/1987 Japan .

*Primary Examiner*—Horace M. Culver

*Attorney, Agent, or Firm*—Hill, Van Santen, Steadman & Simpson

[57] ABSTRACT

Firstly, elongated tape-like articles from a finishing machine are received one by one on a horizontal first pallet above a tray in a bundling or packing station and are then released therefrom the individual article to fall upon receipt. Secondly, the successive articles from the first pallet are received on a horizontal second pallet between the first pallet and the tray to store the articles in stack, and are then released all of the stored articles from the second pallet to fall as a set onto the tray when the number of the stored articles reaches a first predetermined value. When the number of sets of the articles stacked on the tray reaches a second predetermined value, the entire stack of the articles are bundled or packed and are then removed from the tray.

4 Claims, 4 Drawing Sheets

METHOD AND APPARATUS FOR STACKING ELONGATED TAPE-LIKE ARTICLES

BACKGROUND OF THE INVENTION

1. Field of the Invention

The present invention relates to a method of and an apparatus for stacking a predetermined number of elongated tape-like articles, such as slide fasteners, in a stack ready to be bundled with a band or to be packed in a box.

2. Description of the Prior Art

U.S. Pat. Nos. 4,610,124, issued Sept. 9, 1986, and 4,570,422, issued Feb. 18, 1986, respectively disclose a method of and an apparatus for automatically bundling slide fasteners. In the prior art, finished slide fasteners discharged from a slide fastener finishing machine at regular time intervals are successively conveyed to a position above a bundling station and then fall on a tray in the bundling station. When the number of the slide fasteners thus stacked on the tray reaches a predetermined value, such a stack of the slide fasteners is bundled with a band and is then removed from the tray. The bundling and removing of each stack of the slide fasteners must be finished by the time a succeeding slide fastener falls on the tray. Practically, however, since the bundling and removing operation is slow, the subsequent discharging of the finished slide fasteners must be retarded or temporarily discontinued in order to be timed with the bundling and removing operation, which is laborious, thus causing only a limited rate of production. Another problem with the prior art is that the pile of the finished slide fasteners tends to become disorderly as the pile progressively grows.

SUMMARY OF THE INVENTION

It is therefore an object of the present invention to provide a method of and an apparatus for stacking a predetermined number of elongated tape-like articles in an orderly fashion so that the stack of the articles can be bundled easily and reliably, irrespective of the rate at which the successive finished articles are discharged from a finishing machine.

According to the present invention, firstly, elongated tape-like articles from a finishing machine are received one by one on a horizontal first pallet above a tray in a bundling or packing station and are then released therefrom, the individual article to fall upon receipt. Secondly, the successive articles from the first pallet are received on a horizontal second pallet between the first pallet and the tray to store the articles in stack, and then all of the stored articles from the second pallet are released to fall as a set onto the tray when the number of the stored articles reaches a first predetermined value. When the number of sets of the articles stacked on the tray reaches a second predetermined value, the entire stack of the articles are bundled or packed and are then removed from the tray in lieu thereof the time a subsequent set of the articles is released from the second pallet.

Many other advantages, features and additional objects of the present invention will become manifest to those versed in the art upon making reference to the detailed description and the accompanying drawings in which a structural embodiment incorporating the principles of the present invention is shown by may of illustrative example.

DETAILED DESCRIPTION

Figure 1:
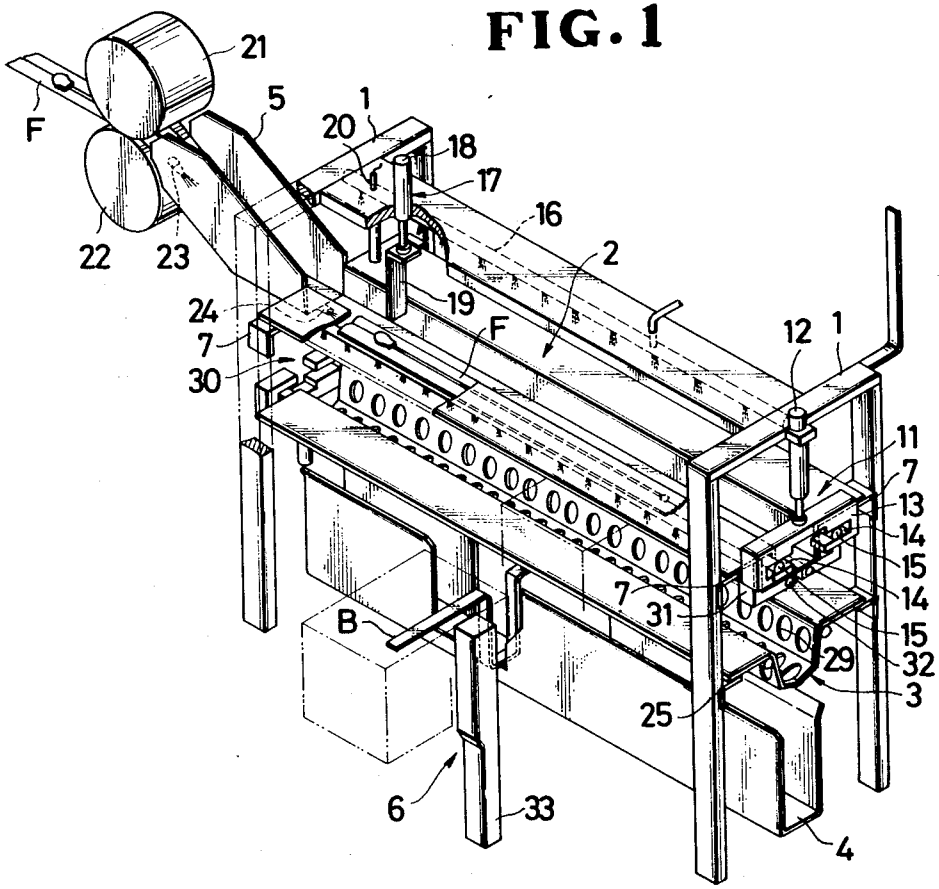
FIG. 1 is a perspective view, with parts broken away, of an apparatus embodying the present invention.
Figure 2:
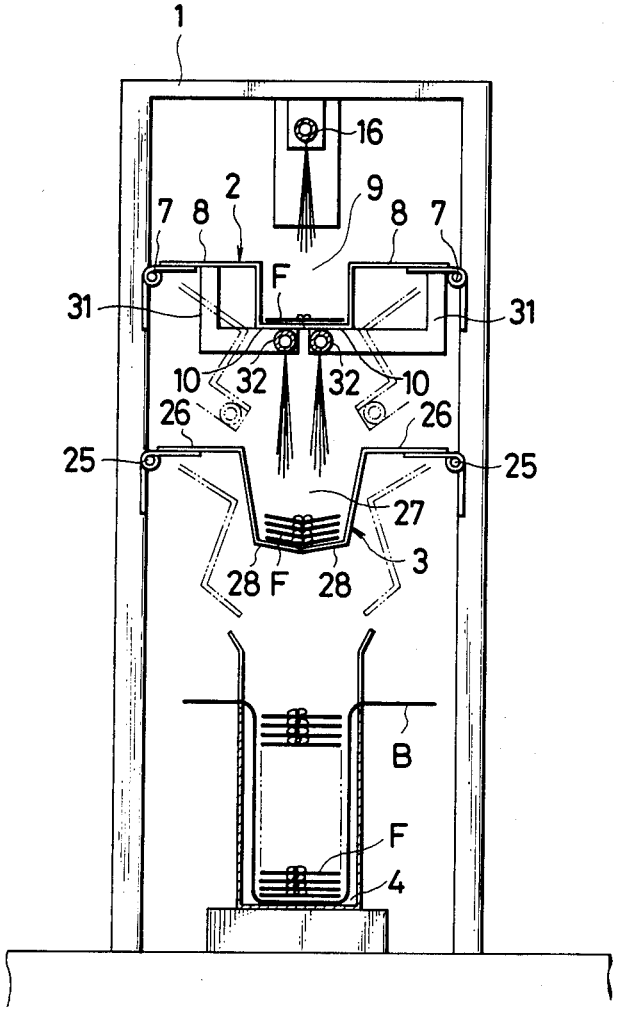
FIG. 2 is a side elevational view, partly in cross section, of the apparatus.

FIGS. 1 and 2 show an apparatus for piling or stacking a predetermined number of elongated tape-like articles F, such as finished slide fasteners, in an orderly fashion ready to be bundled by a bundling apparatus 6.

The stacking apparatus generally comprises a first pallet 2 horizontally supported on a pair of frame members 1, a second pallet 3 supported on the frame members 1 and disposed below the first pallet 2 in parallel spaced relation thereto, and a tray 4 disposed below the second pallet 3 in parallel spaced relation thereto. A chute 5 is contiguous to one end of the first pallet 2 for conveying finished slide fasteners F onto the first pallet 2, the slide fasteners F being fed from a slide fastener finishing machine (not shown) into the chute 5 by a pair of feed rollers 21, 22.

The first pallet 2 includes a pair of first wings 8, 8 each having a generally Z-shaped or S-shaped cross section including a flange, a bottom wall 10, and a side wall extending between the flange and the bottom wall 10. Each first wing 8 is pivotally connected at an outer edge of the flange to the frame members 1, 1 by means of a pair of hinges 7, 7; the two first wings 8, 8 are pivotally movable between a closed position in which the two first wings 8, 8 are close to each other to jointly define a first longitudinal recess 9 for receiving therein the finished slide fasteners F from the chute 5, and an open position in which confronting inner edges of the bottom walls 10, 10 of the two first wings 8, 8 are remote from each other to open the bottom of the first longitudinal recess 9 for releasing the finished slide fasteners F to fall. In the closed position of the first pallet 2, the two bottom walls 10, 10 assume their horizontal posture.

The closing and opening of the first pallet 2 are performed by a first closing and opening unit (hereinafter referred to as "first opening unit") 11. The first opening unit 11, as shown in FIG. 1, includes a first air cylinder 12 vertically supported on one of the frame members 1 remote from the chute 5, and a wing holder 13 horizontally fixed to a piston rod of the first air cylinder 12. The wing holder 13 is moved downwardly and upwardly as the piston rod of the first air cylinder 12 is extended and shrunk, respectively. The wing holder 13 has a pair of horizontal slits 14, 14 in which a pair of pins 15, 15 projecting from the respective first wings 8, 8 are horizontally slidably received respectively. As the wing holder 13 is moved downwardly, the two pins 15, 15 of the first wings 8, 8 slide horizontally away from each other in the respective slits 14, 14, thus causing the two first wings 8, 8 to pivotally move about the respective hinges 7, 7 downwardly from the solid-line position of FIG. 2 and the phantom-line position of FIG. 2. Thus the bottom of the first pallet 2 is opened. Reversely, as the wing holder 13 is moved upwardly, the two pins 15, 15 of the first wings 8, 8 slide horizontally toward each other in the respective slits 14, 14, thus causing the first wings 8, 8 to pivotally move about the respective hinges 7, 7 upwardly from the phantom-line position to the solid-line position. Thus the bottom of the first pallet 2 is closed.

As shown in FIG. 1, the individual finished slide fastener F having been fed into the chute 5 is inserted into the longitudinal recess 9 of the first pallet 2 by air jets from first and second nozzles 23, 24 disposed at opposite ends of the chute 5. The finished slide fastener F is then stopped at a predetermined position by a stopping unit 17 disposed adjacent to the meeting point of the chute 5 and the first pallet 2. The stopping unit 17 includes a sensor 20 supported by the frame member 1 for detecting the leading end of the finished slide fastener F to issue a first detection signal and also for detecting a slider of the finished slide fastener F, a second air cylinder 18 vertically supported by the frame member 1 and operable, upon receipt of the first detection signal from the sensor 20, to extend its piston rod, and a stop 19 vertically fixed to the piston rod of the second air cylinder 18 and movable, in response to the extension of the piston rod of the second air cylinder 18, to such an extent that the lower end of the stop 19 substantially contacts the upper surface of the finished slide fastener F. When the slider of the finished slide fastener F is brought into contact with the stop 19, the sensor 20 detects the slider to issue a second detection signal to terminate the air jets from the first and second nozzles 23, 24. Thus a predetermined number of the successive finished slide fasteners F are placed in stack at a predetermined position in the longitudinal recess 9 of the first pallet 2.

Subsequently, when the first pallet 2 is opened upon energization of the first cylinder 12, the finished slide fasteners F fall from the bottom of the first pallet 2 upon receipt from the finishing machine, in their horizontal posture. A third nozzle 16 is supported by the frame members 1 and extends horizontally over the first pallet 2 in vertical alignment with the longitudinal recess 9. The third nozzle 16 is in the form of a pipe having a plurality of apertures for spraying air jets uniformly over the upper surface of the individual slide fastener, thus serving to assist in keeping the slide fastener in horizontal posture while it is falling.

The second pallet 3, like the first pallet 2, includes a pair of second wings 26, 26 each having a generally Z-shaped or S-shaped cross section including a flange, a bottom wall 28, and a side wall extending between the flange and the bottom wall 28. Each second wing 26 is pivotally connected at an outer edge of the flange to the frame members 1, 1 by means of hinges 25, 25; the two second wings 26, 26 are pivotally movable between a closed position in which the two second wings 26, 26 are close to each other to jointly define a second longitudinal recess 27 for receiving therein the stack of the finished slide fasteners F released from the first pallet 2, and an open position in which confronting inner edges of the bottom walls 28, 28 of the two second wings 26, 26 are remote from each other to open the bottom of the second longitudinal recess 27 for releasing the finished slide fasteners F to fall.

A pair of fourth nozzles 32, 32 is supported by a pair of support arms 31, 31 fixed to the bottom surface of the first wings 8, 8 of the first pallet 2. Each of the fourth nozzles 32 is in the form of a horizontal pipe having a plurality of apertures for spraying air jets over the stack of the finished slide fasteners F in the second longitudinal recess 27 while the stack is being received by the second pallet 3.

The second pallet 3 is different from the first formed pallet 2 in that a multiplicity of openings 29 (FIG. 1) is formed in the side walls and the bottom walls 28, 28. The openings 29 serve as an escape for the air jets from the fourth nozzles 32, 32 to prevent occurrence of turbulent flows, thus preventing the finished slide fasteners F from being dishevelled by the turbulent flows. The second pallet 3 is different from the first pallet 2 also in that with the second pallet 3 closed, the two bottom walls 28, 28 of the opposed second wings 26, 26 slope downwardly toward their confronting inner edges.

The closing and opening of the second pallet 3 are performed by means of a second closing and opening unit (hereinafter referred to as "second opening unit) 30 (FIG. 1). Since the second opening unit 30 is similar to the first opening unit 11 in construction and operation, its detailed description is omitted here for clarity. The second opening unit 30 is controlled by a suitable control circuit (not shown) so as to open the second pallet 3 each time when the number of the finished slide fasteners F stored in the second pallet 3 reaches a selected value, four in the illustrated example. Thus the finished slide fasteners F are supplied a predetermined number at a time from the second pallet 3 to the tray 4 disposed below the second pallet 3.

The tray 4 is in the form of a gutter or trough having a flat bottom surface. The bundling apparatus 6 is disposed substantially centrally of the tray 4 and includes a binding band B of paper drawn from a roll and extending transversely across the tray 4 on the inside surface thereof, and a stapler 33 for joining prospective opposite ends of the binding band B. For bundling, with a free end of the binding band B (gripped by a gripper, not shown), a predetermined number of the finished slide fasteners F is piled on and across the binding band B in the tray 4. The opposite ends of the binding band B are joined together by the stapler 33 after the binding band B encircles the entire stack of the finished slide fasteners F in the tray 4.

The air jets from the fourth nozzle 32, 32 also serve to assist in preventing the upper finished slide fasteners F from rising or floating off the stack in the tray 4.

Figure 3A:
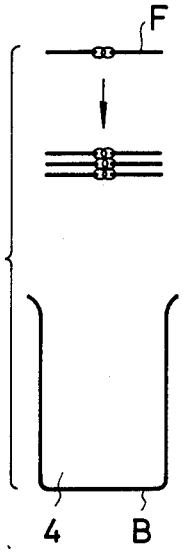
FIGS. 3A through 3J are schematic views illustrating a sequence of steps of a method according to the present invention.
Figure 3B:
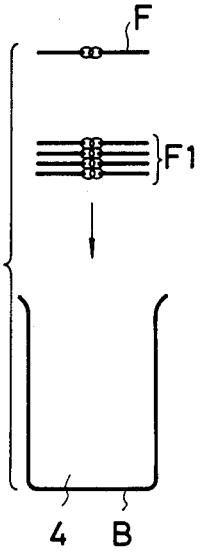
Figure 3C:
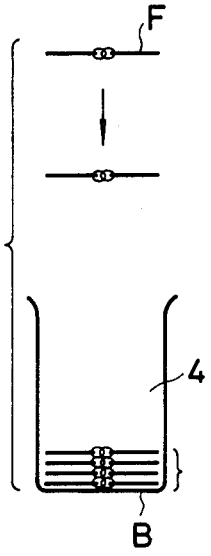
Figure 3D:
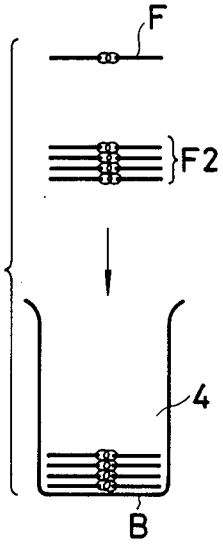
Figure 3E:
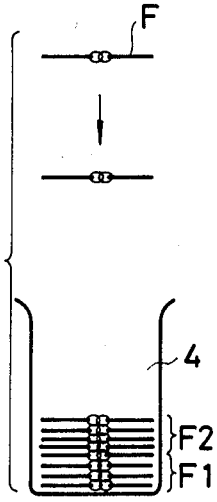
Figure 3F:
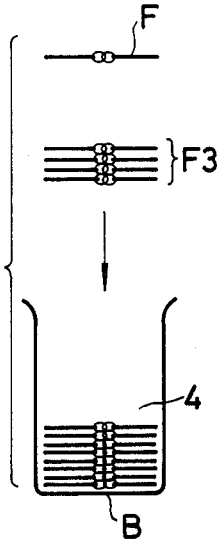
Figure 3G:
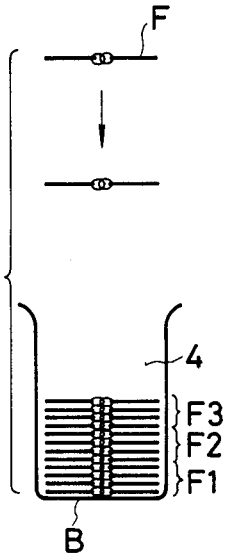
Figure 3H:
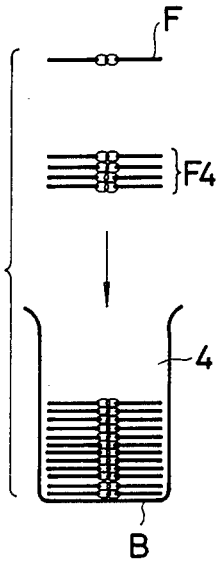
Figure 3I:
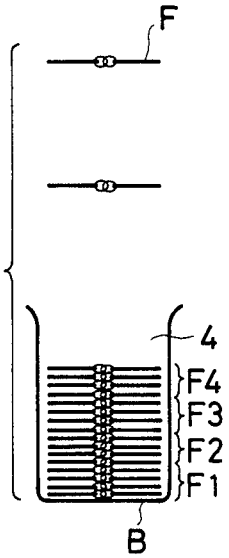
Figure 3J:
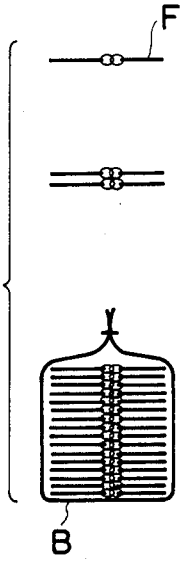

With the apparatus thus constructed, the stacking method is performed, as illustrated in FIGS. 3A through 3J, in a sequence of the following steps: receiving finished slide fasteners F at a first position (the first pallet 2) in horizontal posture one by one at regular intervals, the first position being disposed above the tray 4 in a bundling station; releasing the individual finished slide fastener F to fall upon receipt at the first position; temporarily storing the successive finished slide fasteners F from the first position (first pallet 2) at a second position (the second pallet 3) disposed between the first position and the tray 4 until the number of the finished slide fastener F stored reaches a first predetermined value, and then releasing such a set of the first predetermined number of the finished slide fasteners F1 to fall onto the tray 4, (FIGS. 3A and 3B); repeating the storing step of FIGS. 3A and 3B to provide a second set of the same number of the finished slide fasteners F2 and then releasing the second set of the finished slide fasteners F2 to fall onto the first set of the finished slide fasteners F1 (FIGS. 3D and 3E); and repeating the storing and releasing steps of FIGS. 3D and 3E until the number of sets of the finished slide fasteners F1, F2, F3, F4 stacked in the tray 4 reaches a second predetermined value (FIGS. 3F through 3J). Subsequently, the second predetermined number of sets of the finished slide fasteners F1, F2, F3, F4 are bundled with the binding band B, during which time succeeding finished slide fasteners F are being successively released from the first position (the first pallet 2) to the second position (the second pallet 3). By the time the number of the finished slide fasteners F thus newly stored at the second position reaches the first predetermined value, such a bundle of the finished slide fasteners F1, F2, F3, F4 is removed out of the tray 4, thus making the tray 4 empty and hence ready to receive the subsequent sets of the finished slide fasteners F1, F2, F3, F4 released from the second position.

According to the present method, since the succeeding finished slide fasteners F discharged from the finishing machine are stored at the second position successively without interruption while a predetermined amount of the finished slide fasteners F1, F2, F3, F4 previously stacked in the tray 4 is being bundled, accurate and efficient bundling of the finished slide fasteners can be achieved without reducing the rate of discharging the finished slide fasteners from the finishing machine, thus causing an improved rate of production. Another advantage of the present method is that partly because the number of the finished slide fasteners to be stored as a set at the second position is small, e.g. a fourth of the total number of the finished slide fasteners to be finally stacked in the tray, and partly because the difference in level or height between the first and second position is small, the finished slide fasteners can be stacked at the second position in an orderly fashion. Likewise, since the difference in level or height between the second position and the tray, the sets of the finished slide fasteners can be stacked in the tray in an orderly fashion. Further, since the finished slide fasteners stacked at the second position are released to fall into the tray at once as a single set, the individual slide fasteners of the stack in the tray are free from being twisted or curved.

According to the present apparatus, partly because each of the first and second pallets is openable at the bottom, and partly because at least one nozzle extends over each of the first and second pallets for spraying air jets downwardly, it is possible not only to release elongated tape-like articles such as finished slide fasteners to fall in horizontal posture, but also to prevent the piled articles from rising or floating off the stack.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A method of stacking elongated tape-like articles in a bundling or packing station, comprising the steps of:

(a) receiving the tape-like articles in a horizontal posture one by one at regular intervals at a first position disposed above a tray in the bundling or packing station;

(b) releasing the individual tape-like article to fall upon receipt at the first position;

(c) spraying air jets uniformly over an upper surface of the individual tape-like article so as to keep the tape-like article in a horizontal posture while the latter is falling;

(d) receiving the successive tape-like articles from the first position in a horizontal posture at a second position between the first position and the tray to store the successive tape-like articles in stack;

(e) spraying air jets over the stack of the tapelike articles while the stack is being received at the second position;

(f) releasing all the stored tape-like articles from the second position to fall in a horizontal posture as a set onto the tray when the number of the stored tape-like articles reaches a first predetermined value; and (g) repeating the last-named receiving and releasing until the number of sets of the tape-like articles stacked on the tray reaches a second predetermined value.

2. An apparatus for stacking elongated tape-like articles in a bundling or packing station, the tape-like articles being discharged successively from a finishing machine, said apparatus comprising:

(a) a frame;

(b) a horizontal first pallet supported on said frame at a first position above the bundling or packing station for receiving the tape-like articles in horizontal posture, said first pallet being openable at a bottom thereof;

(c) a first closing and opening unit for opening said first pallet to release the individual tape-like article upon receipt to fall;

(d) a horizontal second pallet supported on said frame at a second position between said first pallet and the bundling or packing station for receiving the successive tape-like articles in horizontal posture in stack, said second pallet being openable at a bottom thereof;

(e) a second closing and opening unit for opening said second pallet to release all of the stored tape-like articles from said second pallet as a set to fall when the number of the stored tape-like articles reaches a predetermined value; and (e) a horizontal tray disposed in the bundling or packing station for receiving successive sets of the tape-like articles from said second pallet one set over another set, wherein said first pallet includes a pair of first wings pivotally connected to said frame for movement between a closed position in which said pair of wings is close to each other to jointly define a first longitudinal recess for receiving therein the tape-like articles, and an open position in which confronting inner edges of said pair of first wings are remote from each other to open the bottom of said first longitudinal recess, and wherein said closing and opening unit includes a first air cylinder vertically supported on said frame, and a wing holder horizontally fixed to said first air cylinder, said wing holder having a pair of horizontal slits in which a pair of pins each projecting from one end of the respective first wing is horizontally slidably received respectively, said pair of first wings being pivotally movable between said closed position and said open position as said pair of pins is moved toward and away from each other in the respective horizontal slits when said wing holder is moved vertically in response to extending and shrinking of said piston rod of said first air cylinder.

3. An apparatus for stacking elongated tape-like articles in a bundling or packing station, the tape-like articles being discharged successively from a finishing machine, said apparatus comprising;

(a) a frame;

(b) a horizontal first pallet supported on said frame at a first position above the bundling or packing station for receiving the tape-like articles in a horizontal posture, said first pallet being openable at a bottom thereof, said first pallet including a pair of first wings pivotally connected to said frame for movement between a closed position in which said pair of wings is close to each other to jointly define a first longitudinal recess for receiving therein the tape-like articles, and an open position in which confronting inner edges of said pair of first wings are remote from each other to open the bottom of said first longitudinal recess;

(c) a nozzle supported by said frame and extending horizontally over an parallel to said first pallet in vertical alignment with said first longitudinal recess for spraying air jet downwardly;

(d) a first closing and opening unit for opening said first pallet to release the individual tape-like article upon receipt to fall;

(e) a horizontal second pallet supported on said frame at a second position between said first pallet and the bundling or packing station for receiving the successive tape-like articles from said first pallet to store the tape-like articles in a horizontal posture in stack, said second pallet being openable at a bottom thereof, said second pallet including a pair of second wings pivotally connected to said frame for movement between a closed position in which said pair of second wings are close to each other to jointly define a second longitudinal recess for receiving therein the successive tape-like articles, and an open position in which confronting inner edges of said pair of second wings are remote from each other to open the bottom of said second longitudinal recess;

(f) a second closing and opening unit for opening said second pallet to release all of the stored tape-like articles from said second pallet as a set to fall when the number of the stored tape-like articles reaches a predetermined value; and (g) a horizontal tray disposed in the bundling or packing station for receiving successive sets of the tape-like articles from said second pallet one set over another set.

4. An apparatus according to claim 3, wherein said second pallet has a multiplicity of openings in side walls and bottom walls of said second longitudinal recess along the entire length of said second pallet.

* * * * *